United States Patent [19]

Haehnel et al.

[11] Patent Number: 5,058,818

[45] Date of Patent: Oct. 22, 1991

[54] MULTI-STRAND BOBBIN WINDING APPARATUS

[75] Inventors: Rudolf H. Haehnel; Ronald S. Schartel, both of Reading, Pa.

[73] Assignee: Magnatech International, Inc., Sinking Spring, Pa.

[21] Appl. No.: 477,337

[22] Filed: Feb. 8, 1990

[51] Int. Cl.[5] ..... B65H 54/02; B65H 54/28; B65H 63/00

[52] U.S. Cl. ..... 242/42; 242/18 R; 242/40; 242/43 R; 242/47.03

[58] Field of Search ..... 242/42, 43 R, 18 R, 242/25 R, 47.01, 47.03, 47.08, 47.09, 39, 40

[56] References Cited

U.S. PATENT DOCUMENTS

| | | | |
|---|---|---|---|
| 1,849,983 | 3/1932 | Junkers | 242/47.09 |
| 2,136,556 | 11/1938 | Lovett | 242/47.03 |
| 2,442,336 | 6/1948 | Bauer | 242/47.09 X |
| 2,682,335 | 6/1954 | Welsh et al. | 242/47.09 |
| 2,930,103 | 3/1960 | Stanley | 242/47.09 X |
| 3,912,185 | 10/1975 | Yamada | 242/47.03 |
| 3,933,319 | 1/1976 | Sachleben, Sr. et al. | 242/18 R |
| 4,154,410 | 5/1979 | Haehnel et al. | 242/18 R |
| 4,462,552 | 7/1984 | Iannucci | 242/42 |

OTHER PUBLICATIONS

Automatic Multiwire Winding Machine, National--Standard Company Limited.

*Primary Examiner*—Stanley N. Gilreath
*Attorney, Agent, or Firm*—Eckert Seamans Cherin & Mellott

[57] ABSTRACT

An apparatus winds multiple strand ends on a bobbin, strands of the ends forming a band. A pair of metering wheels accept said plurality of strand ends from tensioned supply spools and equalize their lengths. The metering wheels are rotatable on angularly inclined axes such that the band proceeds on a helical path. A rotation sensor on the metering wheels senses the speed of the band. A threading assist clamp is mounted for helical displacement on a threaded crank arm for placing the strands on the metering wheels as a group, the clamp being removable from the crank arm to accomplish threading downstream of the metering wheels. A traversing mechanism and bobbin drive wind the band on the bobbin, the traversing mechanism having a compensating pulley and a reciprocating pulley driven by distinct thread pitch areas along a common shaft. A processor senses rotation of the metering wheels and controls both a bobbin drive motor and a reversing servo motor for rotating and reversing the common shaft. The processor can be responsive to an operator interface for winding bobbins under direction from the operator interface, and can produce management reports.

16 Claims, 4 Drawing Sheets

MULTI-STRAND BOBBIN WINDING APPARATUS

BACKGROUND OF THE INVENTION

1. Field of the Invention

This invention relates to the field of bobbin winding apparatus wherein a plurality of strands are to be wound together on a bobbin in a multi-strand band at constant length, and in particular to such an apparatus including a canted Godet wheel, a threading means therefor, and control apparatus for minimizing differences in length while maximizing efficiency of the bobbin winding operation.

2. Prior Art

In winding a plurality of strands on a bobbin to provide a multi-strand band for example to be used in braiding or wrapping a reinforcing sheath for high pressure hose and the like, it is necessary to ensure that during unwinding the bobbin the length of all the strands in the band is equal. If length varies among the strands, the resulting differences in strand tension weaken the braided or wrapped sheath. Winding the multi-strand and on a bobbin involves collecting individual strands from a plurality of sources, normally single-strand spools which are spaced from one another and disposed at differing distances from the winding station such that strands must be brought together from a variety of angles and/or over a variety of linear spans to be wrapped commonly in the band. The supply spools are typically mounted on tensioning mounts, which are individually adjusted to maintain a predetermined tension; however, the precise tension of strands from a plurality of sources normally varies somewhat. In collecting and feeding the individual strands, it is difficult to ensure that the length of the individual strands remains equal.

A known apparatus for equalizing variations in strand length among a plurality of parallel strands is a Godet wheel. A Godet wheel arrangement typically includes two capstans around which fed strands are wrapped for a predetermined number of revolutions, strand length variations among the strands tending to become equalized by a capstan effect as the strands are worked by passage around a common path. In a known multi-strand bobbin winder, the strands from single-strand spools are collected by feeding them through a guide comb onto a capstan, the guide comb positioning the strands at a lateral spacing defined by teeth of the guide comb. Additional guide combs ensure a lateral displacement of the band when passing from one capstan to the other, whereby the band passes helically over each capstan wheel, exiting the paired capstans to be wrapped on a bobbin by means of a feed head which reciprocates parallel to the axis of the bobbin. Typically, a number of combs and idler wheels are encountered by the strands and by the band of strands, for guiding them through changes of direction between their respective source spools and the multi-strand bobbin being wound. These guide combs are a frictional obstruction to equalizing length, and often become the site of a strand break or fouling problem.

Known multi-strand bobbin winding apparatus are also time consuming to set up. The path of the strands through the apparatus must be such that the individual strands remain parallel to define the band, without crossing along the path. Typically, the operator threads the strands through the apparatus individually, pulling each strand end in turn through the guide apparatus, around the capstan to the outlet. The strands are each laid carefully in place, being pulled against the tension of the supply spools. The apparatus must be threaded whenever a supply spool is changed, for example every twenty five bobbins or so (assuming no breakage during winding from a given supply spool). Threading represents a major part of the overall downtime of the apparatus.

If any of the single strand supply spools runs out during the progress of winding a multi-strand bobbin, or if a strand should break, the multi-strand bobbin is reduced substantially to its salvage value. Lengths remaining on individual supply spools which are shorter than a full bobbin length when a companion supply spool runs out are likewise reduced in value. Efficiency requires that all the single strand spools feed a continuous supply during winding and that the supply spool lengths used in winding multi-strand bobbins correspond to an integral multiple of length of the bobbins. Maximizing efficiency in this regard requires keeping track of the supply available from all the supply spools and the amounts expended in winding multi-strand bobbins. According to the present invention, the apparatus used for winding the bobbins, and more particularly the capstan wheels which equalize strand length, are instrumented for management reporting and analysis of the remaining supplies on the supply spools. In this manner, the apparatus can keep a running total of available resources, with appropriate warnings preventing the initiation of a winding operation that cannot be completed.

U.S. Pat. No. 4,154,410—Haehnel et al discloses a multi-strand bobbin winding apparatus wherein strands from individual supply spools are collected and wound over a metering wheel. The strands are positioned using guide combs. The strands lead to the bobbin by way of a reciprocating feeder. The feeder is arranged such that the multi-strand band passes parallel to the bobbin axis from a fixed feeding port to a compensating pulley, then again parallel to the bobbin axis to a reciprocating second pulley, the second pulley reciprocating over the full length of the bobbin for guiding the strand onto the bobbin. The compensating pulley is reciprocated over half the distance that the second pulley is reciprocated, to thereby cancel the effect of the relative variation in feeding speed produced by the fact that the strand is doubled around the compensating pulley. The result is a constant feed rate and constant strand length fed to the bobbin. However, the respective moving parts of the apparatus are engaged to their driving means and to one another by means of belts and gears. The apparatus does not include means for monitoring the available lengths of strand on the respective supply spools, or for relating the available lengths to the usage in winding bobbins.

A bobbin winding apparatus for yarn is disclosed in U.S. Pat. No. 4,462,552—Iannucci. The apparatus includes a pair of capstan or Godet wheels as described above, for equalizing the length of individual strands of yarn when fed in a group defining a band.

U.S. Pat. No. 3,720,054—Haehnel et al; U.S. Pat. No. 3,896,860—Iannucci; U.S. Pat. No. 4,034,642—Iannucci et al; and U.S. Pat. No. 4,729,278—Graeff et al disclose devices for winding strands or bands to reinforce hose and the like, which may be of interest. U.S. Pat. No. 3,839,939—Wily; U.S. Pat. Nos. 3,907,229 and 4,765,220, both to Iannucci et al, disclose tensioning devices for strand spools.

The teachings of each of the noted patents is incorporated herein insofar as they relate to the handling of strands.

SUMMARY OF THE INVENTION

It is an object of the invention to provide a multi-strand bobbin winding apparatus which more effectively equalizes strand length variations from plural sources, but with less possibility of obstructing the strands than according to known devices.

It is also an object of the invention to provide a multi-strand bobbin winder with improved control and information reporting.

It is another object of the invention to facilitate threading of the supply strands by guiding the supply strands along a threading path as a group.

It is a further object of the invention to provide a bobbin winder with a traversing mechanism that is accurately movable in close correspondence with strand speed, while permitting selection of a full range of bobbin, strand and speed parameters.

It is yet another object of the invention to provide a bobbin winder with improved winding accuracy and apparatus durability, by minimizing the number and complexity of bobbin winder parts.

These and other objects are accomplished by an apparatus which winds multiple strand ends on a bobbin, strands of the ends forming a band. A pair of metering wheels accept said plurality of strand ends from tensioned supply spools. The metering wheels are rotatable on angularly inclined axes such that the band proceeds on a helical path as the strand lengths are equalized by the metering wheels. A rotation sensor on the metering wheels senses the speed of the band. A threading assist device clamps the multiple strands and guides the strands along a threading path, the threading assist device having a removable clamp handle for manually handling the strand ends as a group. A traversing mechanism and bobbin drive wind the band on the bobbin, the traversing mechanism having a compensating pulley and a reciprocating pulley driven by distinct thread pitch areas along a common shaft. A processor senses rotation of the metering wheels and controls a reversing servo motor for rotating and reversing the common shaft. The processor can be responsive to an operator interface for winding bobbins under direction from the operator interface to accommodate ranges of a strand diameter, number of strand ends in the band, a bobbin type, a bobbin flange thickness, a traverse distance, traverse end positions, a required bobbin band length and a required strand speed. A bobbin drive motor rotates the bobbin and thereby draws the band over the metering wheels and through the traversing mechanism as the processor synchronizes operation of the servo motor.

BRIEF DESCRIPTION OF THE DRAWINGS

There are shown in the drawings the embodiments that are presently preferred. It should be understood, however, that the invention is not limited to the precise arrangements and instrumentalities shown in the drawings and is capable of embodiment in other forms and other groupings of its sub-elements. In the drawings.

DETAILED DESCRIPTION OF THE PREFERRED EMBODIMENTS

Figure 1:
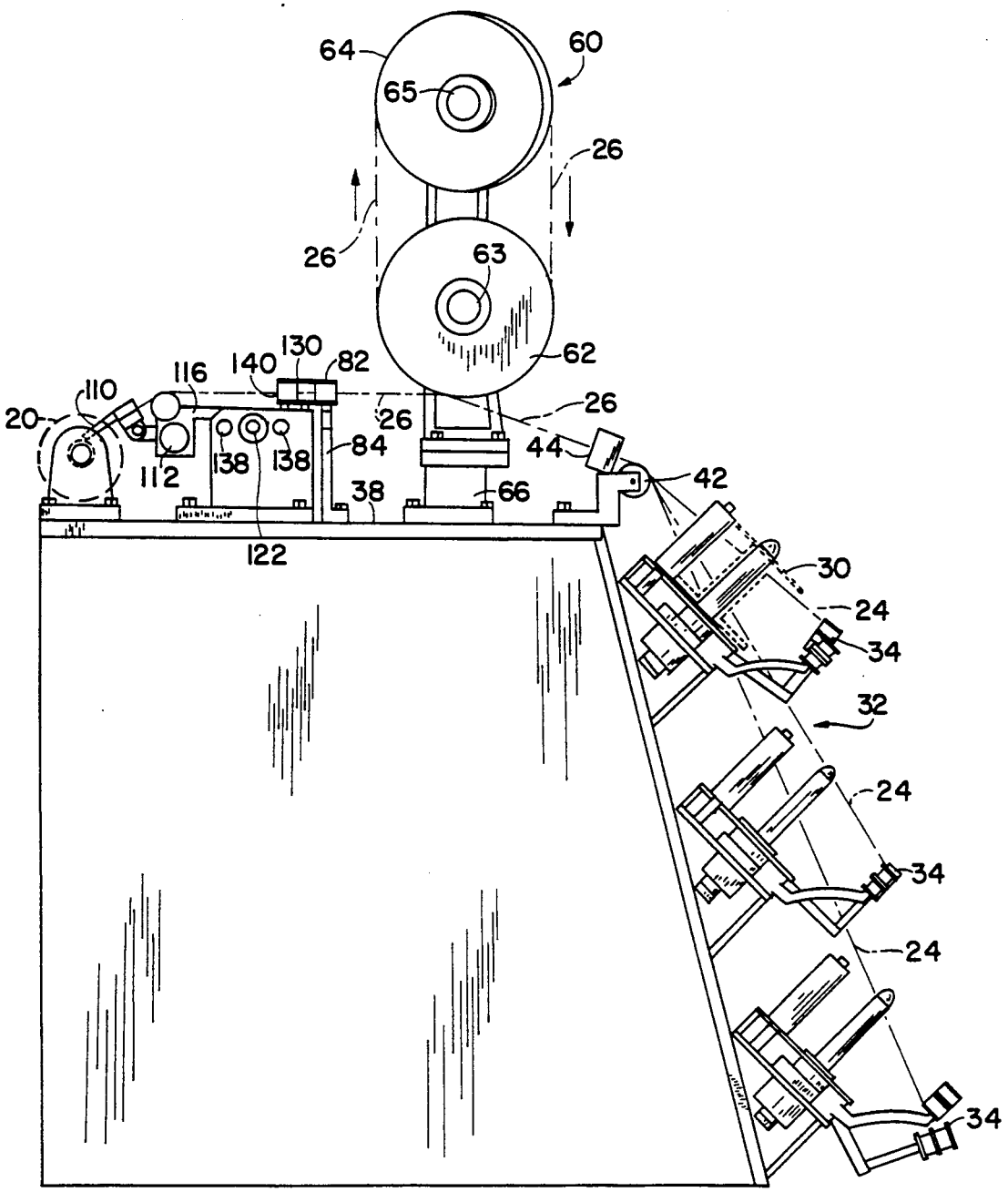
FIG. 1 is an elevation view, partly in section, of a multi-strand bobbin winding apparatus in accordance with the invention.
Figure 2:
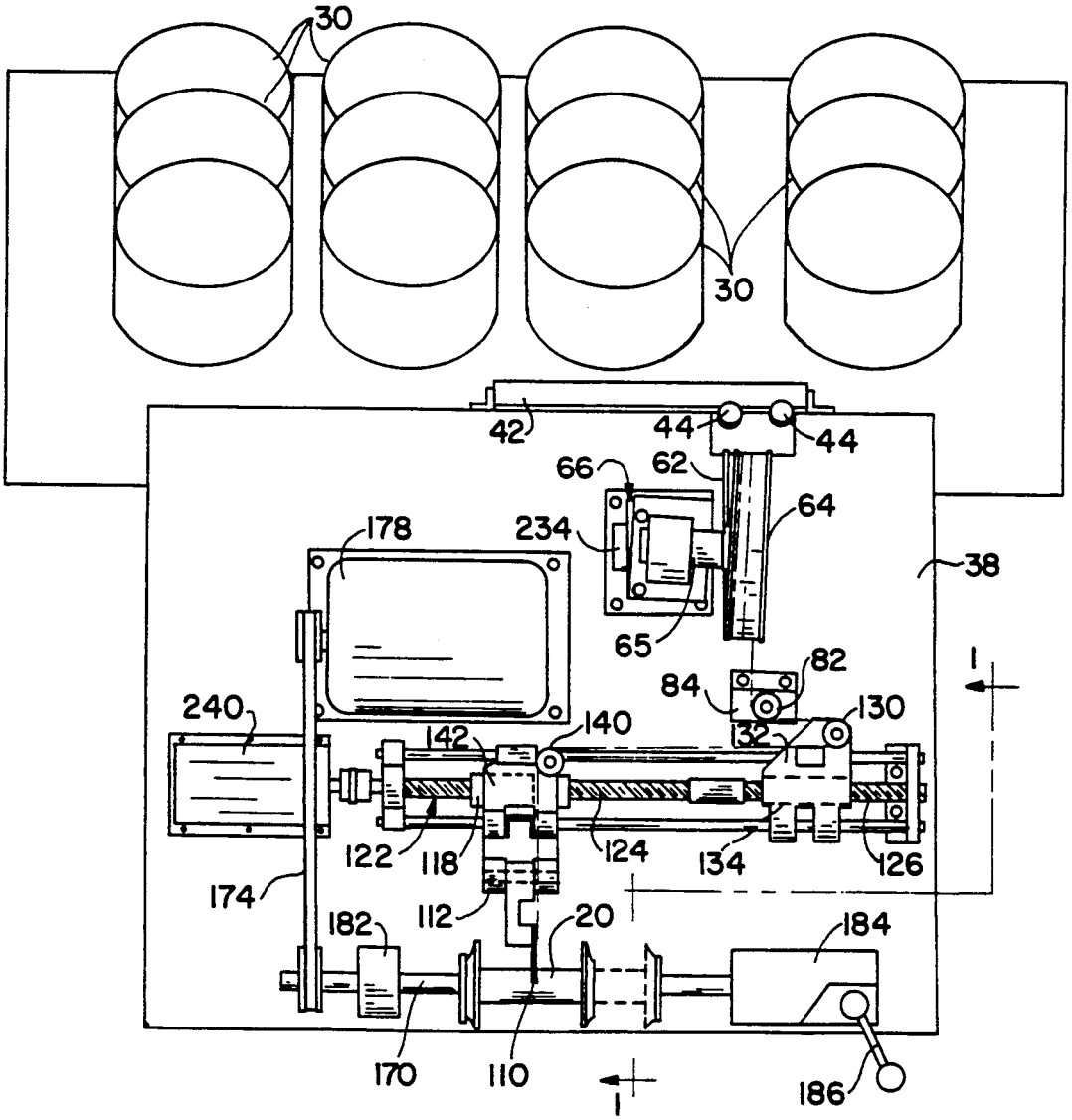
FIG. 2 is a top plan view thereof.

In FIG. 1, the multi-strand bobbin winding apparatus of the invention is shown in elevation, with a portion of the means for affixing the bobbin to the apparatus cut away, as shown at section line 1—1 in FIG. 2. The apparatus includes supply spool mounting means for individual supply spools, each of which dispenses one strand end, for example a single integral strand, but also possibly a multi-strand end formed by a number of individual integral strands, disposed adjacent one another or twisted together. The strand ends are passed through a strand length equalizing Godet wheel arrangement and are wound on a bobbin 20 (shown in phantom lines in FIG. 1) in the form of a belt of strand ends. In order to dispense the belt to fill the available volume between the end flanges of the bobbin, the belt is dispensed through a movable beak that oscillates back and forth over the axial length of the bobbin, the beak being mounted on a traversing mechanism. A computer control accurately operates the traversing mechanism as a function of at least one of the bobbin rotational speed and the speed of the belt of strand ends as detected at the length equalizing Godet wheel arrangement. The computer control allows selection of variables applicable to a particular bobbin winding job, controls the traversing mechanism to accomplish the job, and registers information enabling management reporting and monitoring for maximizing production efficiency.

Certain elements of the apparatus are common to that disclosed in U.S. Pat. No. 4,154,410—Haehnel et al, and will not be described here in detail. Reference can be made to the patent for specific information respecting tensioning of the strand supply spools and the structure of the strand guiding beak and bobbin holding means. Unlike the device disclosed in the patent, the present invention is characterized by an improved strand length equalizing apparatus and by features providing improved control and positioning accuracy in the traversing mechanism.

In general, the individual supply spools 30 are arranged at spaced locations on a strand supply station or panel 32. It is not necessary that the supply station be integral with the apparatus or that this particular type of strand supply station be used. The illustrated strand supply station can be inclined as shown, for easy access to the individual spool mountings.

It is also possible to feed supply strand ends from a separate and discrete supply station apparatus or to arrange the supply station in another configuration, provided the individual strand ends can be led to a supply port 42, at which the strand ends are brought together to form a belt of strands. In another preferred embodiment for example (not shown), the strands are supplied from spools disposed on a separate supply station and the strand ends are let off the spools using guides which rotate around the spool. In that case the strands do not pass through a fixed point relative to the spool. In any case, the strands are fed from their individual sources to be collected at the supply port.

The number of strand ends in a belt can be varied as needed for a particular bobbin winding job. For example, five or more wire strands are handled as a belt, this number being useful for structural reinforcement of high pressure hose and the like, to be braided or wrapped at constant tension using the multi-strand belt unwound from one or more bobbins which are wound on the apparatus of the invention.

Figure 4:
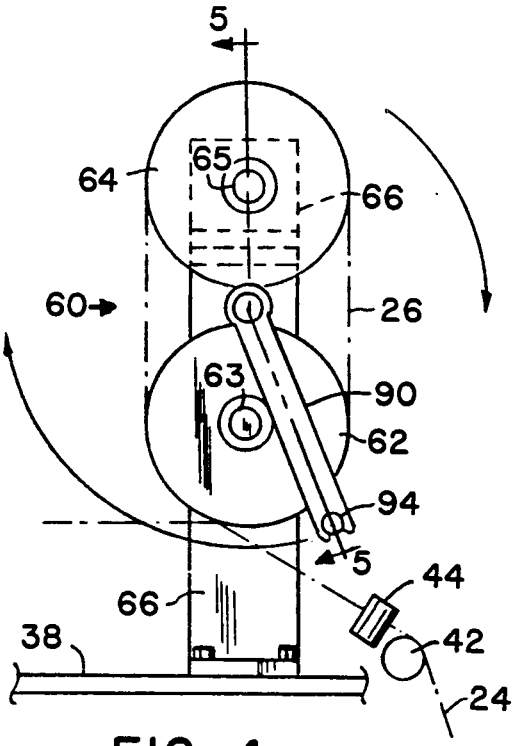
FIG. 4 is a partial elevation view showing a preferred embodiment including a threading apparatus for the metering wheels; and, FIG. 5 is a partial elevation view from the right relative to FIG. 4, partly in section along lines 5—5 in FIG. 4.

The individual supply spools in the illustrated embodiment are tensioned and provided with guiding pulleys 34, for example carried on two arms attached with spring bias to the spool mount such that one of the guiding arms brings the strand to an angular location around the spool clear of the spool, and the other is angularly oriented to direct the strand smoothly along a path to the port 42. The port 42 can be arranged in a number of ways to gather the respective strands into a band. A preferred embodiment is shown in FIG. 4 and is discussed hereinafter. In the embodiment of FIG. 1, the strand port is indicated generally as including rollers 42 and 44, which confine the strands into a band. Roller 42 is axially elongated and rotates on an axis parallel to the first wheel 62 of the Godet wheel arrangement 60. Two spaced rollers 44 confine the strands laterally, the rollers 42, 44 of the strand input port forming a flat band 26 of preferably evenly spaced strands 24 passing onto wheel 62.

The metering wheels 62, 64 rotate clockwise as shown in FIG. 1. The metering wheels are preferably relatively large diameter flanged pulleys having a circumferential surface axially long enough to accommodate several widths of the band, which passes around the Godet wheel arrangement at least once (thereby crossing at the bottom of the lower metering wheel 62), and preferably passing several times around the wheels 62, 64. Preferably, the mounting of the metering wheels 62, 64 is characterized by a certain drag, which can be adjustable for a particular bobbin winding setup. If desired, the drag applied to the metering wheels can be controllable automatically, by including a clutch or brake mechanism (not shown) with an electrical actuator such as a solenoid or the like, to which a variable voltage is applied for varying the force exerted by the drag mechanism. Alternatively, drag can be set by manually adjusting the axial pressure on a frictional fitting by means of a nut on either or both of shafts 63, 65 (see FIG. 5).

The band 26 is led from the port 42 onto the first metering wheel 62 at or near an axial edge of wheel 62, which axial edge is aligned with the corresponding axial edge of canted metering wheel 64 at the tangent where the band passes from the lower wheel to the upper canted wheel 64. The alignment of the metering wheels is illustrated in FIG. 2. In the embodiment shown, the band first contacts lower metering wheel 62 at the leftmost axial edge as shown in FIG. 2, being carried around lower wheel 62 to pass vertically upwardly onto the leftmost axial edge of the canted upper wheel 64. As the band passes circumferentially around the upper wheel 64, the cant of the upper wheel 64 causes the band to be displaced axially to the right with respect to the axis of the lower metering wheel. This allows the band to cross at the bottom of the lower metering wheel, without interference and being guided substantially only by contact with the metering wheels and not by passing through guide combs. By setting the cant angle and by providing sufficient axial length to the metering wheels, the band can pass repeatedly around the Godet wheel arrangement 60, whereupon the strands are worked by a capstan effect and are very accurately equalized in length.

The band exits the Godet wheel arrangement at a tangent to the lower metering wheel 62, which tangent is horizontal in the embodiment shown. At this point the band has passed at least once, and preferably several times, around the metering wheels 62, 64, and accordingly is spaced axially to the right of the point at which the band entered the Godet wheel arrangement 60 from the port 42. The band then passes a guiding pulley 82, which is fixed in position, which feeds the band to oscillating compensating pulley 130, then through traversing pulley 140 and beak 110 to be wound on the bobbin.

The metering wheels 62, 64 are mounted on a column 66, which has a base part attached to table 38. The column 66 can be segmented as shown, with the lower wheel 62 and upper wheel 64 each rotatably mounted in a section of column 66 which is bolted to a lower section of the column. The section carrying the lower metering wheel 62 is simply aligned to the band path and need not be adjustable. More particularly, the section of column 66 carrying the lower metering wheel 62 includes a rotational mounting such as a pillow block or the like for rotatably engaging the shaft 63 of lower wheel 62, and aligns the shaft 63 perpendicular to the band 26. Shaft 63 is perpendicular to the band path along a line between the port 42 and the axial edge of the lower wheel 62 (e.g., the leftmost edge as shown). Shaft 63 is also perpendicular to the path of band 26 along a line between the exit of band 26 from the lower wheel 62 and a tangent to fixed pulley 82, this latter path being spaced axially relative to shaft 63 due to the at least partly helical path of the band around the two metering wheels 62, 64. Pulley 82 is carried on support 84, bolted to table 38.

Preferably, the apparatus of the invention is capable of a range of dimensional setups to accommodate different requirements in strand size, band width and metering needs. Accordingly, the upper metering wheel 64 is preferably adjustable for different setups. Wheel 64 rotates on shaft 65, which is rotatably carried in an uppermost section of column 66 having a base member attachable to a next lower section of column 66 in an angularly adjustable manner as shown in FIG. 2, for setting the cant angle of upper wheel 64 relative to lower wheel 62. In the embodiment shown, the upper section of column 66 is attached to the next lower section by bolts 31 through facing flange plates 33, the bolts extending through slotted holes 35 allowing the upper section to be canted and displaced by rotation around a vertical axis located substantially at a tangent to the lower metering wheel 62 adjacent the flange at which the band is led onto the lower metering wheel (the left flange in FIG. 2). This enables the initial wrap of the band to lead onto the upper metering wheel 64 at the leftmost axial edge, regardless of the cant angle. The number of wraps around the Godet wheel arrangement can be changed or the maximum band width can be changed by changing the cant angle of the upper wheel 64 relative to the lower wheel, the object being to wrap the band around wheels 62, 64 a sufficient number of times to equalize the strand lengths, providing sufficient axial space along the wheels to carry successive wraps. The wheels typically accommodate four or five wraps of a band. The band typically has anywhere from two to twelve or more strand ends.

Figure 5:
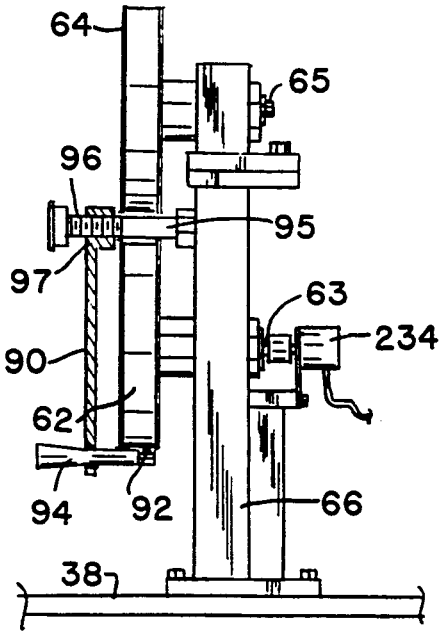

A preferred embodiment for a threading apparatus is shown in FIGS. 4 and 5, these also illustrating the sectional nature of the metering wheel column 66. Threading can be a time consuming and difficult job in view of the fact that it may be necessary to route twelve strand ends around the path defined by the metering wheels, through the traversing mechanism to the beak at the bobbin, setting the strands in a helical arrangement on the wheels 62, 64 and avoiding crossing of the strands along the entire path. This must typically be done while pulling against the tensioners of the supply spools, for example 2.5 lbs (1.1 kg) per strand. In known metering wheel arrangements the strands are threaded individually rather than in a band. According to the invention, the strands can readily be threaded as a band, without risk of crossing the strands and working against the strand supply spool tensioners.

A threading crank 90 is mounted on column 66 to rotate around a horizontal axis at the proximal end of the crank 90, preferably located between the metering wheels 62, 64. The crank 90 is long enough to protrude beyond the top and bottom of the upper and lower metering wheels, respectively. Preferably, the crank is just slightly longer than the required radius to exceed the space occupied by metering wheels. The distal end of crank 90 has a strand engaging clamp 92 and a manually engageable handle, forming parts of a threading handle 94, which can be removed from the distal end of the crank 90, thereby carrying a plurality of clamped strand ends along. The distal end of the crank can define a yoke for engaging the handle member 94, preferably with an interference fit such that the threading handle can be snapped into place for initially threading the band around the metering wheels 62, 64, then snapped out to carry the strand ends through the remainder of the path leading to the bobbin.

The clamp portion of the threading handle can have a flattened end portion with a threaded hole for attaching a clamping plate, the strand ends being captured between the flattened end and the plate. The threading handle can be non-rotatably received within the yoke defined by the distal end of the crank, such that as the crank is rotated around the metering wheels handle 94 revolves about post 95 at the distal end of crank 90 while maintaining a constant orientation with respect to post 95, wherefore the strands do not become wrapped around the clamp portion of the threading handle.

The proximal end of crank 90 is attached to the column 66 at post 95, which includes a threaded portion 96, engaged with a threaded hub 97 attached to the proximal end of the crank. As the crank is rotated on the post 95, hub 97 is displaced axially in the same direction as the helical path along which the strands pass around the metering wheels, i.e., to the left in the representative embodiment shown in FIG. 5. The thread of hub 97 and portion 96 of the post 95 have a thread pitch to cause the band to wrap helically around the metering wheels without overlapping previous wraps. The thread pitch is long enough that the axial displacement of the hub 97 with one revolution of the crank 90 exceeds the width of the widest band to be threaded in this manner. Upon completion of wrapping (i.e., when the band has been wrapped helically around the metering wheels to arrive at the outer (leftmost) axial end of the lower metering wheel, the threading handle is removed from the crank and used to pull the band through the remainder of the band path. The threaded portion 96 and hub 95 can be replaceable (e.g., different cranks can be used and the threaded portion replaced to correspond thereto) to provide a thread pitch that is closely matched to the pitch of the helical path produced by canting of the upper metering wheel relative to the lower one. In any event, as the band advances through the remainder of the path, the metering wheels 62, 64 are thereby rotated, and any discrepancy between the pitch of the crank thread 96 and the particular cant angle of the upper metering wheel is worked out by the time the band completes one transit of the metering wheels.

With reference to FIG. 2, the band 26 proceeds from the lower metering wheel 62 to fixed pulley 82, being turned 90° in the process such that the band rests flat on the pulley 82. The band passes first by 90° around fixed pulley 82 to a movable compensating pulley 130 , then 180° around pulley 130 to a movable traversing pulley 140. The band passes 90° around traversing pulley 140 to beak 110, from which the band is directed onto the bobbin 20. In winding a bobbin, the traversing pulley 140 and the beak 110 oscillate back and forth within a predetermined span, normally substantially equal to the axial space between the flanged ends of bobbin 20. The bobbin is rotated by a driving motor 178, which can be mounted to drive the bobbin support shaft 170 by means of a chain or belt 174.

The traversing mechanism in the preferred embodiment is not driven directly from the bobbin drive motor 178. A servo motor 240 is provided for driving the traversing mechanism, under computer control. The traversing mechanism has two movable carriages that oscillate in phase but at different linear rates. The traversing carriage 142 oscillates by a distance equal to the required span of wrapping on bobbin 20. Carriage 142 is mounted on guide rails 138, 138, which maintain the orientation of the traversing carriage as the carriage is driven back and forth by a threaded shaft 124 that engages a threaded screw nut 118 fixed to the carriage, thereby forming a linear actuating drive. Threaded shaft 124 is journaled at bearings at each end, carried by supporting flanges that are bolted to table 138. Guide rails 138 are fixed in the supporting flanges. Servo motor rotates in one direction for advancing carriage 142, then reverses when the carriage has reached a predetermined traverse endpoint, reversing again when the carriage reaches the opposite endpoint. During the process, the band 26 is wound on bobbin 20 evenly along the length of the bobbin.

The band 26 advances at a constant velocity from metering wheels 62, 64. Inasmuch as the path of band 26 approaching the traversing carriage is directed partly along the line of traverse of the traversing carriage, a problem exists in that the speed of the band will not be constant over a cycle of oscillation of the traversing carriage. Therefore, compensating means are provided to equalize the feed by accumulating the oversupply of the constant velocity band when the traversing carriage is moving counter to the advancing band (toward fixed pulley 82), and paying out the oversupply when the traversing carriage is moving in the same direction as the band. This compensating means is provided by compensating carriage 132. The band passes 180° around compensating pulley 130, rotatably mounted on the compensating carriage. This arrangement produces two lengths of band 26 between the compensating pulley and the fixed pulley 82, which can be regarded as a reference point where the band velocity is constant. By moving the compensating pulley at half the linear speed of the traversing carriage 142, and in phase with the traversing carriage, the two lengths of band 26 between pulley 130 and the reference point of fixed pulley 84 accumulate the band and then pay out the band during each oscillation. Compensating carriage 132 is preferably mounted on a common shaft 122 with the traversing carriage, but moves at a different rate by virtue of a different pitch to the screw nut 134 and threaded section 126 of common shaft 122, than the pitch of the common shaft at section 124, which moves the traversing carriage.

In the preferred embodiment shown, shaft section 126 for the compensating carriage is arranged at half the pitch of shaft section 124 for the traversing carriage. This one-half proportion corresponds to the number of passes of band 26 which are overlapped between the reference point (pulley 82) and the compensating pulley 130. It would be possible to employ an arrangement wherein a different number of passes are employed, and the pitches of compensating shaft section 126 and traversing shaft section 124 have a correspondingly different proportional relationship, the result being a constant band speed at beak 110 notwithstanding relative motion of the traversing mechanism interspersed between the metering wheels 62, 64 and the beak.

It is also possible to employ a compensating apparatus wherein the shafts sections 124, 126 which drive the traversing carriage and the compensating carriage, respectively, are not parts of a common shaft. Preferably, the shaft sections are arranged such that a very accurate proportional speed relationship is maintained between the traversing carriage and the compensating carriage, and this is achieved very dependably with by use of a common shaft because there is no possibility of relative motion between the shaft sections 124, 126 if rigidly attached. In a geared arrangement for synchronizing shaft sections 124, 126 at proportionate driving speeds, on the other hand, backlash caused by play between the gears can produce relative motion between the shaft sections. Backlash is a substantial problem in a traversing mechanism of the present type, due to the need for stopping and reversing the drive motor 240, at the end of every transit of the beak.

Another alternative for a closely controlled and backlash-free drive is to provide separate servo motors for each of the shaft sections 124, 126. Each of the motors can be computer controlled to an accuracy of many steps per revolution. If separately controlled servo motors are provided, the computer controller can be programmed to operate the two shaft sections 124, 126 at Whatever proportional speed relationship as appropriate for a particular bobbin winding setup.

The bobbin winding setup can vary as to the number of strand ends, the character of the strands, the physical dimensions of the bobbin or the windings thereon, and other factors. As shown in broken lines in FIG. 2, an axially longer or shorter bobbin can be received on the bobbin shaft, a manually adjustable span adjusting apparatus 184 being provided for accommodating bobbin variations, and also for installing and removing bobbins from the winding station. The bobbin is engaged between the driven bobbin shaft 170, which is axially fixed in block 182, and a bobbin engaging extension of the span adjusting apparatus 184. Block 182 and span adjusting apparatus 184 are fixed in place by being bolted to table 38. Preferably, the bobbin is carried on stubs of these shafts extending axially through the bobbin flanges, and is also axially engaged by flanges on the shafts, for transmitting rotational force to the bobbin from shaft 170. Variations in the diameter of the bobbin, both initially and with wrapping of underlying layers of band 26, are accommodated by a pivotal mounting of beak 20 at pivot shaft 112.

Bobbin drive motor 178 provides the basic force that moves the band 26 from the supply spools 30 to the bobbin 20. The bobbin drive motor is preferably also controlled by computer input to an inverter or motor controller that can adjust the speed of the bobbin drive motor and thereby control the speed of the band through the apparatus. The bobbin drive motor need not be so closely controlled as the servo motor 240, the latter type of motor being controllable, if desired, to an accuracy of as little as a fraction of a degree and being readily stopped and reversed. Preferably, the bobbin drive motor is accelerated and decelerated smoothly during startup, speed-controlled variations and stopping, to prevent problems due to the inertia of the band and the band metering wheels. The control enables the computer to smoothly increase or reduce the bobbin speed within limits. The bobbin speed is based, for example, not only by setting and maintaining a maximum bobbin rotation speed, but also a maximum band speed and maximum traversing speed for the traversing carriage.

Figure 3:
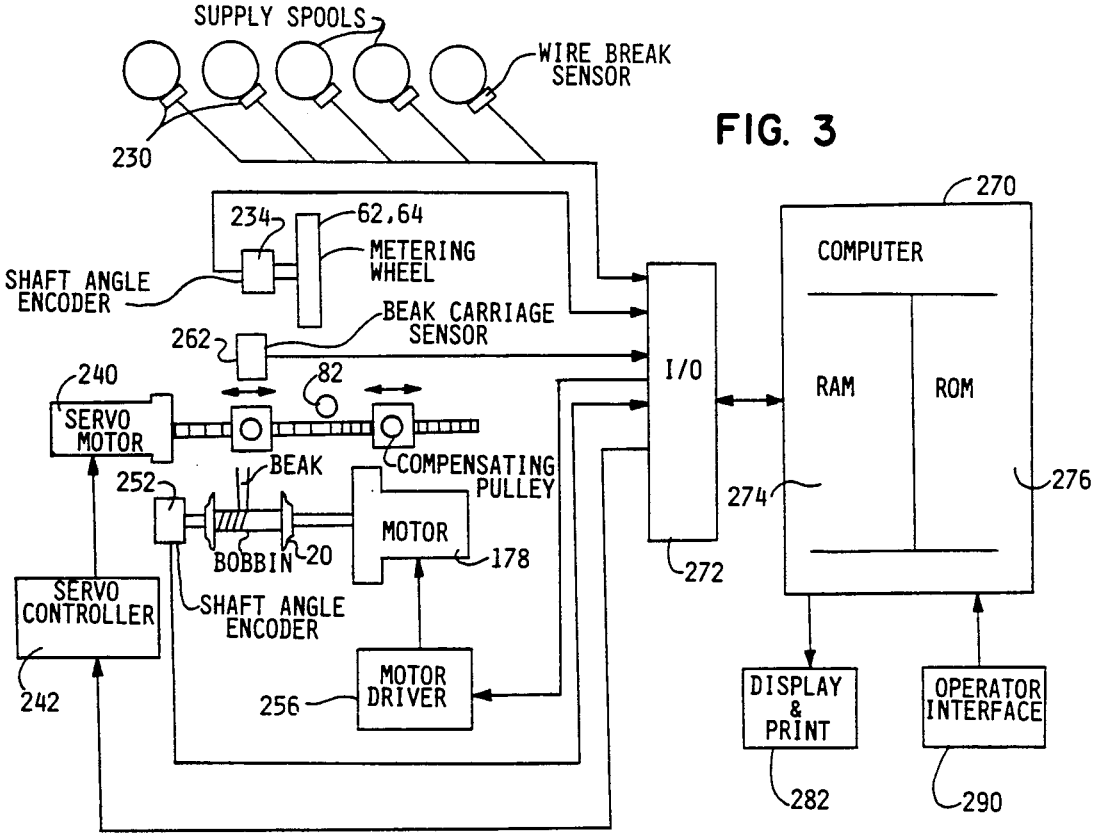
FIG. 3 is a schematic block diagram thereof, including control and reporting features.

The preferred control and sensing apparatus are shown in FIG. 3, which is a schematic representation corresponding roughly with FIG. 2, but including data collection and actuator controlling means, as well as means for operator input/output and a processor for centralized control. The processor includes a digital computer 270, having a read only memory (ROM) 276 for program storage and a random access memory (RAM) 274 for storage of variable data and for effecting a sequence of operations according to operator selected parameters. Input from the operator, for example for defining a bobbin winding operation and for initiating and stopping operation, is accepted via operator interface 290, which preferably includes a switchpad, keyboard, touch sensitive screen or the like, upon which the operator can indicate selections to be executed under control of the computer. Preferably, the operator can input specific parameter values to be maintained, such as one or both traverse endpoints, strand speed to be maintained, total bobbin wrap length, etc. Additionally, the operator can select pre-programmed operations or parameters which relate for example to selection of standard bobbin parameters or standard winding operations. The computer is loaded with a set of data values corresponding to a list of standard bobbins, including the bobbin flange spacing, bobbin shaft diameter or the like, and standard winding jobs, e.g., number of strands, total length, etc. Control parameters such as strand speed limits, traverse endpoints, metering wheel drag and the like are then set by the computer to execute the standard operation without the operator having to define all the control parameters directly. The computer preferably prompts the operator for sufficient data to define a particular job, portions of the necessary information being preset constants stored in ROM. Alternatively or in addition, the operator can input data defining new or nonstandard jobs in a like manner. Variations in preset jobs can be arranged to require the operator, supervisor or process technician to enter a password before enabling a new operation.

A display and printing apparatus 282 is included for indicating the current status of the computer such as the currently programmed job and the like. The display/-printer 282 preferably is operable to read out the current values of parameters during a winding operation, and also produces management reports. The number of bobbins produced, the type of bobbins produced, downtime and production efficiency reports are preferably available.

Process data is obtained apart from the operator interface by means of an input/output interface 272. This may include optical isolators, analog to digital or digital to analog converters, multiplexers and similar means for converting sensor outputs to digital information for effecting computations or controls, as well as converting computer data to control outputs for operating the respective actuators. The computer receives information from one or more strand break sensors 230, shaft angle encoders 234 and 252 for monitoring rotation of the metering wheels 62, 64 and the bobbin drive shaft, respectively, and beak carriage position sensor 262. Outputs from the computer 270 through I/O interface 272 control the bobbin drive motor 178 through bobbin motor driver 256, and traverse servo motor 240, through servo controller 242.

The strand break sensor(s) 230 can be placed at one or more convenient positions anywhere along the strand path. In connection with winding wire on a bobbin, the conductivity of the wire can be used to detect breakage. Preferably, the wire break sensor(s) includes a conductive aperture positioned such that the strand or strands pass through the aperture when advancing properly. If a strand breaks, a free end of the strand drops or whips out of the strand path and contacts the conductive aperture, thereby grounding the aperture and providing a signal to the computer. It is also possible to detect strand breakage by monitoring tension of a strand, for example by passing the strand over a movable idler roller spring biased toward the strand path and using a limit switch to provide a strand break input when the roller is no longer held back by the continuous tensioned strand.

Shaft angle encoders 234, 252 on the metering wheel arrangement and bobbin drive shaft, respectively, provide either a train of pulses with rotation, which pulses are counted to register rotation of the metering wheels, or alternatively the shaft angle encoders can provide instantaneous angle data, which is periodically read by the computer 270. These inputs are used to develop data on both the length of strand passing the metering wheels and the instantaneous rotational speed of the metering wheels and the bobbin drive shaft. The length of passing strand is accumulated so that the bobbin winding operation can be stopped when a predetermined length is wound on the bobbin. The rotational speed of the metering wheels and the bobbin drive shaft are controlled by controlling the power applied to bobbin drive motor 178 through motor driver 256, which pulls the strand through the apparatus. The strand speed, traversing rate and bobbin rotational speed are preferably controlled to preset maximum and/or minimum limits. At the beginning of a winding operation, the bobbin rotates faster relative to the strand speed because the bobbin shaft diameter is small. At this stage, the bobbin drive motor is controlled to keep the bobbin rotation rate and the traversing rate below safe upper limits. Later in the winding operation, the effective diameter of the bobbin shaft is increased by underlying windings, and the bobbin drive motor rotational speed is controlled to keep the strand speed below a safe upper limit. The speeds are controlled between maximum and minimum limits so that winding and traverse are safe and accurate, and to avoid overloading the bobbin drive motor 178, the servo motor 240 or the linear actuator elements.

Servo controller 242 and servo motor 240 do not require a shaft angle encoder because the servo is a positioning (substantially non-slipping) drive and computer 270 can register the current position of the traversing mechanism by keeping track of the stepping instructions applied to the servo motor through servo controller 242. In order to set traverse position data to a known point, and/or to prevent accumulation of error in the event of slippage, a beak carriage sensor 262 detects when the beak carriage occupies a known position, for example a "home" position detected by a limit switch, photodetector or the like.

In connection with winding wire strands, it is preferable to control the bobbin rotational speed between about 1,250 and 3,750 RPM, and to maintain a wire linear speed below about 1,720 ft./min. The traversing drive is preferably controlled to a proportion of the bobbin rotation rate, which proportion is adjustable by operator input or by setting predetermined limits, for example providing a traverse rate between about 0.025 to 0.250 inches per bobbin revolution. This translates into a linear traverse rate of between 1.6 and 16.0 inches per second at the maximum bobbin RPM. The traverse rate preferably is kept at or below two or three reversals per second. These parameters assume a bobbin drive motor of about 3 HP and a traversing drive around 1.5 HP. The rates can be revised upwardly or downwardly for more or less demanding strand winding applications by making corresponding changes in the elements.

Automatic shutoffs are preferably effected in the event of a broken strand, as noted above. The apparatus can also be arranged to shut down automatically when the bobbin is full, or when the beak position reaches a predetermined maximum. The beak position can be detected by a limit switch operable when the beak is pivoted to a maximum angle around its pivot 112.

In addition to the data developed for controlling bobbin rotation and traverse, the apparatus includes a system clock and means for accumulating management reports on the operation and efficiency of operation over a desired interval. Reports are available, for example, on time efficiency (percentage of run time to total time); material use (in feet or meters and by type); number of bobbins produced (including type); average bobbin winding time; average downtime between bobbins; and number and type of alarms or shutoffs. These reports are preferably maintained by shift, batch and/or hourly bases. A number of variations such as recording or uploading information can be included if desired.

The invention as disclosed and claimed is an apparatus for winding multiple strand ends 24 on a bobbin 20, strands of the ends forming a band 26. Means 30, 32, 34 deliver a plurality of individual strand ends 24 to a supply port 42, 44. A pair of metering wheels 62, 64 are disposed to accept said plurality of strand ends 24 from the supply port 42, 44, the strands of said ends 24 being parallel and laterally spaced to define the band 26. A first metering wheel 62 is rotatable on an axis 63 perpendicular to the band 26 and is positioned to receive the band 26 adjacent one lateral edge of said first metering wheel 62. A second metering wheel 64 is rotatable on an axis 65 parallel to a plane including the first metering wheel 62 and angularly canted relative to the first metering wheel, whereby the band 26 proceeds around said pair of metering wheels 62, 64 on an at least partly helical path a band pickup 82 mounted on a fixed axis. A traversing mechanism 140, 142 and bobbin drive 178 are operable to wind the band 26 on the bobbin 20, the traversing mechanism operating on the band downstream of the metering wheels along a band path. The means for delivering the plurality of individual strand ends 24 to the supply port 42, 44 includes a supply spool station 32 having spool holders for separate single end supply spools 30, the spool holders having adjustable strand tensioners, strands of the single ends 24 extending from the supply spools 30 to the supply port 42, 44 and from the supply port to the metering wheels 62, 64. The strands 24 extend freely from the supply port 42, 44 through the metering wheels 62, 64 to the band pickup, which preferably includes a band pickup pulley 82, without encountering a guide comb.

Means 234 are provided for sensing rotation of the metering wheels 62, 64, and a processor 270 is connected to the means 234 for sensing rotation of the metering wheels 62, 64 and to an operator interface 290 including a manually operable data input means, the processor 270 being operable to receive from the data input means information respecting an available length on each of said separate individual supply spools and to register an available length during at least one bobbin winding operation by decrementing said available length as a function of rotation of the metering wheels 62, 64.

The traversing mechanism includes a compensating pulley 130 and a reciprocating pulley 140, the band 26 extending from the band pickup pulley 82 to the compensating pulley 130, and to the reciprocating pulley 140, the reciprocating pulley 140 being fixed relative to a screw nut 118 and linearly movable along an axis of the bobbin 20 in an oscillating manner for winding the band 26 along an axial length of the bobbin 20, the compensating pulley 130 being fixed relative to a further screw nut 134 and linearly movable at a rate proportional to a rate of the reciprocating pulley 140 and in phase with the reciprocating pulley 140. The first screw nut 118 and the further screw nut 134 are carried on a common threaded shaft 122 having distinct thread pitches 124, 126. A reversing servo motor 240 rotates and reverses the common shaft 122, the servo motor 240 being controlled by the processor 270, said processor being operable to control the servo motor 240 for winding bobbins 20 under direction from the operator interface 290 to accommodate ranges of at least one of a strand diameter, a number of strands in the band, a bobbin type, a bobbin flange thickness, a traverse distance, a traverse end position, a required bobbin band length and a required strand speed.

The bobbin drive includes a bobbin drive motor 178 operable to rotate the bobbin 20 and thereby draw the band 26 over the metering wheels 62, 64 and through the traversing mechanism 140, 142, 130, 132, the processor 270 synchronizing operation of the servo motor 240 to a bobbin speed sensed by a means 252 for sensing rotation of the bobbin 20. The processor 270 is further operable to produce management reports including a computation over a predetermined interval of at least one of an apparatus run time, a number of bobbins produced, a number of bobbins produced per setup type, a total of linear strand length, a time between bobbins and a bobbin run time. At least one alarm condition sensor 230 is connected to the processor 270 and is operable to produce at least one of an alarm indication and a stoppage of the apparatus responsive to detection of said alarm condition.

The invention may be characterized as an apparatus for winding multiple strands 24 on a bobbin 20, the strands forming a band 26, the apparatus comprising means 30 for delivering a plurality of individual strands 24 to a supply port 42, 44, and a pair of metering wheels 62, 64 disposed to accept said plurality of strands from the supply port 42, 44, the strands 24 being parallel and laterally spaced to define the band 26, said metering wheels including a first metering wheel 62 rotatable on an axis 63 perpendicular to the band 26 and positioned to receive the band 26 adjacent one lateral edge of said first metering wheel 62, and a second metering wheel 64 rotatable on an axis 65 parallel to a plane including the axis 63 of the first metering wheel 62 and angularly canted relative to the first metering wheel 62, whereby the band 26 proceeds around said pair of metering wheels on an at least partly helical path, around said pair of metering wheels to a band pickup mounted on a fixed axis. A threading apparatus 90, 92, 94 for the metering wheels 62, 64, includes a crank 90 mounted for rotation around said pair of metering wheels 62, 64 and a clamp 92 operable to engage a plurality of strand ends 24, the clamp 92 being disposed adjacent the metering wheels 62, 64 such that rotation of the crank 90 passes the clamp 92 and the strand ends 24 around the metering wheels 62, 64. The crank 90 rotates on a threaded hub 97 having a pitch at least equal to a width of the band 26 per revolution of the crank 90, whereby rotation of the crank 90 wraps the band 26 helically on the metering wheels 62, 64. The crank includes a handle member 94 which is removable from the crank 90, the handle member 94 including said clamp 92, whereby the handle member 94 can be used to thread the band 26 over the metering wheels 62, 64 and then removed from the crank 90 to thread the band 26 along a path downstream of the metering wheels 62, 64.

Drive means 178, 174, 182, 170 rotate the bobbin 20 to draw the threaded band 26 over the metering wheels 62, 64 and through a traversing mechanism, and means 234 are provided for sensing rotation of the metering wheels 62, 64. A servo motor 240 is operable to advance and reverse the traversing mechanism. A processor 270 is connected to the means 234 for sensing rotation and to the servo motor 240, 242, the processor 270 being operable to control the servo motor 240 as a function of a rotational speed of the bobbin 20. The processor 270 is operable to control the servo motor 240 to wind bobbins 20 for predetermined attributes with respect to at least one of a strand diameter, a number of strands in the band, a bobbin type, a bobbin flange thickness, a traverse distance, traverse end positions, a required bobbin band length and a required strand speed. The operator interface 290 connected to the processor 270 accepts variable input data from an operator for presetting at least one of the predetermined attributes. Means for sensing rotation includes a shaft angle encoder for sensing rotation of one of the metering wheels and/or the bobbin drive.

The processor is further operable to produce management reports including a computation over a predetermined interval of at least one of an apparatus run time, a number of bobbins produced, a number of bobbins produced per setup type, a total of linear strand length, a time between bobbins and a bobbin run time.

The invention having been disclosed, a number of variations within the scope of the invention will now become apparent to persons skilled in the art. Reference should be made to the appended claims rather than the foregoing discussion of exemplary embodiments, in assessing the scope of the invention in which exclusive rights are claimed.

What is claimed is:

1. An apparatus for winding multiple strand ends on a bobbin, strands of the ends forming a band, the apparatus comprising:

means for delivering a plurality of individual strand ends to a supply port;

a pair of metering wheels disposed to accept said plurality of strand ends from the supply port, the strands of said ends being parallel and laterally spaced to define the band, said metering wheels including a first metering wheel rotatable on an axis perpendicular to the band and positioned to receive the band adjacent one lateral edge of said first metering wheel, and a second metering wheel rotatable on an axis parallel to a plane including the first metering wheel and angularly canted relative to the first metering wheel, whereby the band proceeds on an at least partly helical path around said pair of metering wheels to a band pickup mounted on a fixed support;

a traversing mechanism and bobbin drive operable to wind the band on the bobbin, the traversing mechanism operating on the band downstream of the metering wheels along a band path;

the means for delivering the plurality of individual strand ends to the supply port including a supply spool station having spool holders for separate single end supply spools, the spool holders having adjustable strand tensioners, strands of the single ends extending from the supply spools to the supply port and from the supply port to the metering wheels; and, means for sensing rotation of the metering wheels, and a processor connected to the means for sensing rotation of the metering wheels and to an operator interface including a manually operable data input means, the processor being operable to receive from the data input means information respecting an available length on each of said separate individual supply spools and to register an available length during at least one bobbin winding operation by decrementing said available length as a function of rotation of the metering wheels.

2. The apparatus according to claim 1, wherein the traversing mechanism including a compensating pulley and a reciprocating pulley, band extending from the band pickup to the compensating pulley, around 180° to the reciprocating pulley, the reciprocating pulley being fixed relative to a screw nut and linearly movable along an axis of the bobbin in an oscillating manner for winding the band along an axial length of the bobbin, the compensating pulley being fixed relative to a further screw nut and linearly movable at a rate proportional to a rate of the reciprocating pulley and in phase with the reciprocating pulley.

3. The apparatus according to claim 2, wherein the first screw nut and the further screw nut are carried on a common threaded shaft having distinct thread pitches, and further comprising a reversing servo motor for rotating and reversing the common shaft, the servo motor being controlled by the processor, said processor being operable to control the servo motor for winding bobbins under direction from the operator interface to accommodate ranges of at least one of a strand diameter, a number of strands in the band, a bobbin type, a bobbin flange thickness, a traverse distance, a traverse end position, a required bobbin band length and a required strand speed.

4. The apparatus according to claim 3, wherein the bobbin drive includes a bobbin drive motor operable to rotate the bobbin and thereby draw the band over the metering wheels and through the traversing mechanism, the processor synchronizing operation of the servo motor to a bobbin speed sensed by a means for sensing rotation of the bobbin.

5. The apparatus according to claim 2, wherein the processor is further operable to produce management reports including a computation over a predetermined interval of at least one of an apparatus run time, a number of bobbins produced, a number of bobbins produced per setup type, a total of linear strand length, a time between bobbins and a bobbin run time.

6. The apparatus according to claim 5, further comprising at least one alarm condition sensor connected to the processor and operable to produce at least one of an alarm indication and a stoppage of the apparatus responsive to detection of said alarm condition.

7. An apparatus for winding multiple strands on a bobbin, the strands forming a band, the apparatus comprising:

means for delivering a plurality of individual strands to a supply port;

a pair of metering wheels disposed to accept said plurality of strands from the supply port, the strands being parallel and laterally spaced to define the band, said metering wheels including a first metering wheel rotatable on an axis perpendicular to the band and positioned to receive the band adjacent one lateral edge of said first metering wheel, and a second metering wheel rotatable on an axis parallel to a plane including the axis of the first metering wheel and angularly canted relative to the first metering wheel, whereby the band proceeds around said pair of metering wheels on an at least partly helical path around said pair of metering wheels to a band pickup pulley mounted on a fixed axis;

a threading apparatus for the metering wheels, including a crank mounted for rotation around said pair of metering wheels and a clamp operable to engage a plurality of strand ends, the clamp being disposed adjacent the metering wheels such that rotation of the crank passes the clamp and the strand ends around the metering wheels; and, a threaded hub on which the crank rotates having a pitch at least equal to a width of the band per revolution of the crank, whereby rotation of the crank wraps the band helically on the metering wheels.

8. An apparatus for winding multiple strands on a bobbin, the strands forming a band, the apparatus comprising:

means for delivering a plurality of individual strands to a supply port;

a pair of metering wheels disposed to accept said plurality of strands from the supply port, the strands being parallel and laterally spaced to define the band, said metering wheels including a first metering wheel rotatable on an axis perpendicular to the band and positioned to receive the band adjacent one lateral edge of said first metering wheel, and a second metering wheel rotatable on an axis parallel to a plane including the axis of the first metering wheel and angularly canted relative to the first metering wheel, whereby the band proceeds around said pair of metering wheels on an at least partly helical path around said pair of metering wheels to a band pickup pulley mounted on a fixed axis;

a threading apparatus for the metering wheels, including a crank mounted for rotation around said pair of metering wheels and a clamp operable to engage a plurality of strand ends, the clamp being disposed adjacent the metering wheels such that rotation of the crank passes the clamp and the strand ends around the metering wheels, the crank including a handle member which is removable from the crank, the handle member including said clamp,, whereby the handle member can be used to thread the band over the metering wheels and then removed from the crank to thread the band along a path downstream of the metering wheels.

9. An apparatus for winding multiple strands on a bobbin, the strands forming a band, the apparatus comprising:

means for delivering a plurality of individual strands to a supply port;

a pair of metering wheels disposed to accept said plurality of strands from the supply port, the strands being parallel and laterally spaced to define the band, said metering wheels including a first metering wheel rotatable on an axis perpendicular to the band and positioned to receive the band adjacent one lateral edge of said first metering wheel, and a second metering wheel rotatable on an axis parallel to a plane including the axis of the first metering wheel and angularly canted relative to the first metering wheel, whereby the band proceeds around said pair of metering wheels on an at least partly helical path around said pair of metering wheels to a band pickup pulley mounted on a fixed axis;

a traversing mechanism including a compensating pulley and a reciprocating pulley, band extending from the band pickup pulley to the compensating pulley, around 180° to the reciprocating pulley, the reciprocating pulley being fixed relative to a screw nut and linearly movable parallel to an axis of the bobbin in an oscillating manner for winding the band along an axial length of the bobbin, the compensating pulley being fixed relative to a further screw nut and linearly movable at a proportion of a linear rate of the reciprocating pulley and in phase with the reciprocating pulley;

drive means for rotating the bobbin to draw the band over the metering wheels and through the traversing mechanism;

means for sensing rotation of the metering wheels;

a servo motor operable to rotate and reverse the common shaft; and, a processor connected to the means for sensing rotation and to the servo motor, the processor being operable to control the servo motor as a function of a rotational speed of the bobbin.

10. The apparatus according to claim 9, wherein the processor is operable to control the servo motor to wind bobbins for predetermined attributes with respect to at least one of a strand diameter, a number of strands in the band, a bobbin type, a bobbin flange thickness, a traverse distance, traverse end positions, a required bobbin band length and a required strand speed.

11. The apparatus according to claim 10, further comprising an operator interface connected to the processor, the processor accepting variable input data from an operator at the operator interface, for presetting at least one of the predetermined attributes.

12. The apparatus according to claim 9, wherein the means for sensing rotation includes a shaft angle encoder for sensing rotation of one of the metering wheels.

13. The apparatus according to claim 12, wherein the bobbin drive motor is controlled by the processor and further comprising means for sensing rotation of the bobbin, said means for sensing rotation of the bobbin providing an input the processor for feedback control of the bobbin drive motor.

14. The apparatus according to claim 13, further comprising at least one alarm condition sensor connected to the processor and operable to produce at least one of an alarm indication and a stoppage of the apparatus responsive to detection of said alarm condition.

15. The apparatus according to claim 14, wherein the processor is further operable to produce management reports including a computation over a predetermined interval of at least one of an apparatus run time, a number of bobbins produced, a number of bobbins produced per setup type a total of linear strand length, a time between bobbins and a bobbin run time.

16. An apparatus for winding multiple strand ends on a bobbin, forming a band, the apparatus comprising:

means for mounting a plurality of separate single end supply spools and for delivering a plurality of individual ends from the supply spools to a supply port;

a pair of metering wheels disposed to accept said plurality of ends from the supply port, the strands of said ends being parallel and laterally spaced to define the band, said metering wheels including a first metering wheel rotatable on an axis perpendicular to the band and positioned to receive the band adjacent one lateral edge of said first metering wheel, and a second metering wheel rotatable on an axis parallel to a plane including the first metering wheel and angularly canted relative to the first metering wheel, whereby the band proceeds around said pair of metering wheels on an at least partly helical path around said pair of metering wheels to a band pickup pulley mounted on a fixed axis;

a traversing mechanism and bobbin drive accepting the band from the metering wheels and operable to wind the band on the bobbin;

means for sensing rotation of the metering wheels;

a processor connected to the means for sensing rotation of the metering wheels and to a manually operable data input means, the processor being operable to receive from the data input means information respecting an available length on each of said separate individual supply spools and to register an available length during at least one bobbin winding operation by decrementing said available length as a function of rotation of the metering wheels.

* * * * *